US007025133B2

(12) United States Patent
McIntosh

(10) Patent No.: US 7,025,133 B2
(45) Date of Patent: Apr. 11, 2006

(54) MULTIPLE BORE CHRISTMAS TREE OUTLET

(75) Inventor: Gavin J. McIntosh, Edinburgh (GB)

(73) Assignee: FMC Technologies, Inc., Houston, TX (US)

( * ) Notice: Subject to any disclaimer, the term of this patent is extended or adjusted under 35 U.S.C. 154(b) by 97 days.

(21) Appl. No.: 09/932,539

(22) Filed: Aug. 17, 2001

(65) Prior Publication Data

US 2002/0070025 A1 Jun. 13, 2002

(30) Foreign Application Priority Data

Aug. 21, 2000 (GB) ..... 0020591

(51) Int. Cl.
*E21B 33/03* (2006.01)

(52) U.S. Cl. ..... 166/89.1; 166/368; 166/348

(58) Field of Classification Search ..... 166/350, 166/366, 89.2, 308, 89.1, 88.1, 95.1, 348, 166/368, 97.1
See application file for complete search history.

(56) References Cited

U.S. PATENT DOCUMENTS

| | | | | |
|---|---|---|---|---|
| 2,889,886 | A * | 6/1959 | Gould | 166/89.3 |
| 3,357,491 | A * | 12/1967 | Jones et al. | 166/97.5 |
| 3,552,903 | A * | 1/1971 | Townsend, Jr. | 166/356 |
| 3,604,731 | A * | 9/1971 | Petersen | 285/29 |
| 3,653,435 | A | 4/1972 | Reistle, III | |
| 4,082,147 | A * | 4/1978 | Wolff et al. | 166/375 |
| 4,130,161 | A | 12/1978 | Jones | |
| 4,513,823 | A * | 4/1985 | Hynes et al. | 166/386 |
| 4,681,133 | A * | 7/1987 | Weston | 137/315.18 |
| 4,703,807 | A * | 11/1987 | Weston | 166/373 |
| 4,844,156 | A * | 7/1989 | Hesh | 166/263 |
| 5,280,766 | A * | 1/1994 | Mohn | 166/368 |
| 5,544,707 | A * | 8/1996 | Hopper et al. | 166/382 |
| 5,575,336 | A | 11/1996 | Morgan | |
| 5,671,813 | A * | 9/1997 | Lima | 166/372 |
| 5,911,278 | A * | 6/1999 | Reitz | 166/372 |
| 6,196,310 | B1 * | 3/2001 | Knight | 166/105.5 |
| 6,431,285 | B1 * | 8/2002 | Hopper et al. | 166/368 |
| 6,494,266 | B1 * | 12/2002 | Bartlett et al. | 166/339 |
| 2003/0006042 | A1 * | 1/2003 | DeBerry | 166/368 |

FOREIGN PATENT DOCUMENTS

| | | | |
|---|---|---|---|
| GB | 2 038 906 | A | 7/1980 |
| GB | WO 8601852 | A1 * | 3/1986 |
| GB | 2 254 634 | A | 10/1992 |
| WO | WO 97/49892 | | 12/1997 |

* cited by examiner

*Primary Examiner*—David Bagnell
*Assistant Examiner*—Shane Bomar
(74) *Attorney, Agent, or Firm*—Henry C. Query, Jr.

(57) ABSTRACT

A large bore Christmas tree includes a production outlet that is split into multiple separate outlets, each controlled by a separate, standard sized valve and valve actuator.

11 Claims, 1 Drawing Sheet

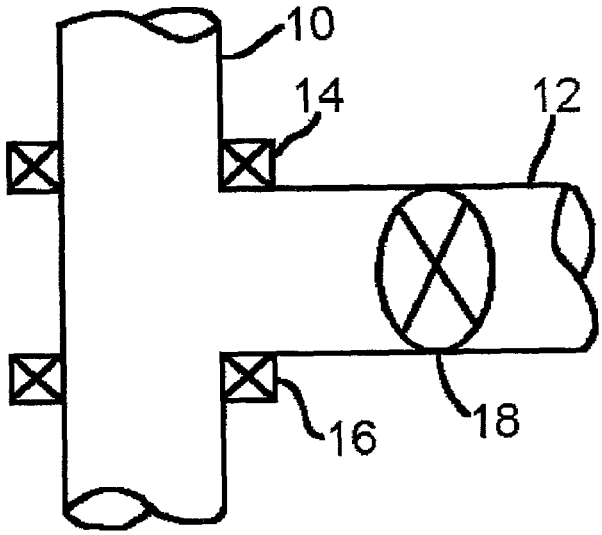
Fig. 1 (prior art)
Fig. 2
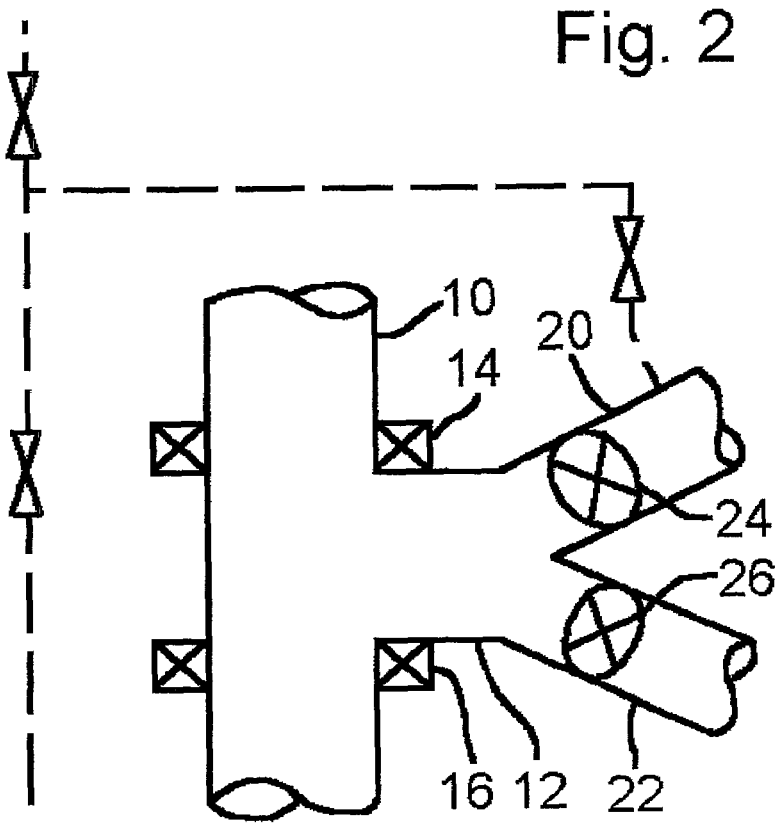

MULTIPLE BORE CHRISTMAS TREE OUTLET

BACKGROUND OF THE INVENTION

This invention relates to production outlets for large bore Christmas trees.

Traditionally, buoyant oil markets have provided the financial justification for the development of, and production from, multiple wells. However, current market circumstances dictate that whilst production volume must be maintained, it must be done with a reduced number of wells. This has led to the development of larger bore production xmas trees.

Large bore production xmas trees, particularly subsea trees utilizing horizontal outlets, present problems with outlet diameters. Current outlet valve technology accommodates outlets of up to 7" (178 mm) diameter. Any production outlet with a diameter of over 7" (178 mm) will require the development of a new subsea gate valve, with the consequent costs involved, as well as the disadvantages of increased size and weight of the new design.

SUMMARY OF THE INVENTION

The present invention solves the above problems by enabling the use of existing standard sized outlet valves and actuators in a large bore production tree. To that end, the present invention provides a production Christmas tree having multiple production outlets extending from a single production bore. Splitting one large production outlet into two or more smaller outlets allows the use of existing subsea gate valves and actuators, with each production outlet being controlled by a separate, standard sized valve, thereby avoiding the cost of development of a new larger subsea gate valve. This system has the further benefit that pressure drops due to reservoir depletion, and associated flow assurance problems, can be alleviated by closing one of the production outlets. Erosion problems are also reduced. Preferably each production outlet has a different diameter. By selecting different outlets or combinations of outlets, a wide range of production flow rates can be catered for, as the reservoir pressure drops over the lifecycle of the field. In a preferred embodiment, two outlets are provided. These may be for example a 7" (178 mm) and a 5" (127 mm) outlet. However other diameters may be used, for example to suit smaller sized valves.

An illustrative embodiment of the invention is described below with reference to the drawings.

BRIEF DESCRIPTION OF THE DRAWINGS

FIG. 1 schematically shows the vertical bore and single horizontal production outlet of a prior art large bore horizontal production tree; and FIG. 2 schematically shows a dual production outlet horizontal tree embodying the invention.

DETAILED DESCRIPTION OF THE PREFERRED EMBODIMENTS

The prior art horizontal xmas tree shown in FIG. 1 has a vertical through bore 10 and a single horizontal production outlet 12 branched off from the vertical bore 10. Annular seals 14, 16 surround the vertical bore 10 above and below the production outlet 12, to seal a tubing hanger (not shown) in the vertical bore 10, as is conventional. A gate valve 18 forming a production master valve is situated in the production outlet 12.

The embodiment of the invention shown in FIG. 2 is similar, except that the horizontal outlet 12 from the production bore is split into two separate outlets 20, 22. One of these outlets 20 is controlled by a 5" (127 mm) subsea gate valve 24 and actuator. The other outlet 22 is controlled by a 7" (178 mm) subsea gate valve 26 and actuator. Other multiple outlet configurations will be readily apparent, for example having other diameters to suit other anticipated production flow rates, or including three or more separate outlets, each controlled by an appropriately sized valve. Although gate valves are generally preferred, other forms of valve may be suitable in particular circumstances. The xmas tree of the invention may also incorporate other features known in prior xmas trees, for example an annulus and/or workover conduit, and a crossover conduit extending between the annulus/workover conduit and one or more of the production outlets. These additional conduits (shown in dotted lines in FIG. 2) will be controlled by suitable valves, as is conventional.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A production Christmas tree comprising:

a generally vertical production bore;

a first production outlet which includes a first end that is connected to the production bore and a second end that extends away from the production bore; and at least second and third production outlets which each extend from the second end of the first production outlet;

wherein in the normal production mode, fluid flowing through the first production outlet is produced through any one of the second and third production outlets or through both of the second and third production outlets simultaneously.

2. A production Christmas tree as defined in claim 1, wherein each of the second and third production outlets has a different diameter.

3. A production Christmas tree as defined in claim 1, wherein one of the second and third production outlets is of 7"(17 8 mm) diameter or smaller.

4. A production Christmas tree as defined in claim 3, wherein the other of the second and third production outlets is of 5"(127 mm) diameter or smaller.

5. A production Christmas tree as defined in claim 1, being a horizontal tree.

6. A production Christmas tree as defined in claim 1, wherein each of the second and third production outlets is provided with a respective valve.

7. In combination with a horizontal Christmas tree comprising a generally vertical production bore, the improvement comprising: a first production outlet which includes a first end that is connected to the production bore and a second end that extends away from the production bore; and at least second and third production outlets which each extend from the second end of the first production outlet.

8. The horizontal Christmas tree of claim 7, wherein the second and third production outlets each have a different diameter.

9. The horizontal Christmas tree of claim 8, wherein one of the second and third production outlets is of 7"(17 8 mm) diameter or smaller.

10. The horizontal Christmas tree of claim 9, wherein the other of the second and third production outlets is of 5"(127 mm) diameter or smaller.

11. The horizontal Christmas tree of claim 7, wherein each of the second and third production outlets is provided with a respective valve.

* * * * *